US005406865A

United States Patent [19]

Galanty

[11] Patent Number: 5,406,865

[45] Date of Patent: Apr. 18, 1995

[54] METHOD FOR PRODUCING ONE-PIECE CUTTER BODY MEMBERS FOR COMMINUTING APPARATUS

[76] Inventor: William B. Galanty, 21 Delwick Ln., Short Hills, N.J. 07078

[21] Appl. No.: 137,564

[22] Filed: Oct. 18, 1993

Related U.S. Application Data

[63] Continuation-in-part of Ser. No. 753,089, Aug. 30, 1991, Pat. No. 275,342.

[51] Int. Cl.[6] ..... B22C 7/02; B22C 4.24

[52] U.S. Cl. ..... 76/115; 76/DIG. 3; 164/24; 164/45

[58] Field of Search ..... 76/115, DIG. 3, 107.1; 164/23, 24, 45, 516–519; 241/236

[56] References Cited

U.S. PATENT DOCUMENTS

| | | | |
|---|---|---|---|
| 1,783,285 | 12/1930 | Goodwin | 76/DIG. 3 X |
| 2,260,593 | 10/1941 | Wittlinger et al. | 76/115 X |
| 2,344,954 | 3/1944 | Aber | 76/115 X |
| 2,782,489 | 2/1957 | Hargrove et al. | 76/115 X |
| 3,998,395 | 12/1976 | Umphrey | 241/236 X |
| 4,139,046 | 2/1979 | Stanciv | 164/45 |
| 4,925,117 | 5/1990 | Ramos | 241/236 |
| 5,160,095 | 11/1992 | Pepper | 241/236 X |

*Primary Examiner*—Douglas D. Watts
*Attorney, Agent, or Firm*—Clay Holland, Jr.

[57] ABSTRACT

An improved method for producing one-piece cutter body members for comminuting apparatus for shredding, crushing and grinding bulk solid waste materials is provided. The process creates one-piece cutter body members having cutter teeth distributed along the length of the body members for rotation when in fixed engagement with twin or multiple parallel shafts of the bulk solid waste material comminuting apparatus. The resulting one-piece cutter body members are adaptable to intermeshing comminuting action each having cutting teeth which may be shaped for cutting in both of two opposite directions of rotation.

13 Claims, 4 Drawing Sheets

METHOD FOR PRODUCING ONE-PIECE CUTTER BODY MEMBERS FOR COMMINUTING APPARATUS

The present application is a Continuation-in-Part of U.S. application for patent Ser. No. 753,089, filed Aug. 30, 1991, entitled "SOLID WASTE CRUSHER AND SIZING APPARATUS", which is now U.S. Pat. No. 5,275,342. The benefits of the earlier filing date is claimed for the subject matter common to both applications.

BACKGROUND OF THE INVENTION

The present invention relates to a process or method for producing cutter body members for solid waste material shredding and comminuting apparatus. Such comminution is commonly performed by feeding solid waste materials into the interface of counter-rotating intermeshing cutters. Shrearing and cutting action may occur when particles of waste material are cut or crushed by such intermeshing cutters.

In the prior art of such comminuting devices there is provided at least a pair of rotating shafts with their axes of rotation parallel to one another, with sets or stacks of individual cutter disks and spacers in alternate spaced apart relationship fixedly mounted on each shaft and mutually intermeshing. The spacers are maintained at a fixed separation distance between the teeth of the cutter disks. When such apparatus is operated over an extended period of time or required to comminute bulky solid waste materials, the individual cutter disks and/or the shredding teeth thereof may become dislodged, distorted, broken-off or slip in rotation along along the axis of the shafts owing to the fact that such cutter disks and teeth are subjected to large shrear, shock, bending and torsion forces which must be borne or carried solely by an individual disk or tooth. Stated differently, there is no opportunity for the sharing or distribution of such forces among the various adjacent disks, teeth or spacers along the axis of a shaft. Consequently, such prior art devices are subject to many undesireable drawbacks and disadvantages, which may be observed as for example in the accummulation of waste materials between the cutter members, failure of one or more of the cutter disks to rotate, misalignment of the cutter teeth, anyone or all of these causes reduced comminution efficiency and reliability and the like.

Apparatus of the type to which the present invention relates, are known and described in the prior art, for example, such as U.S. Pat. No. 4,046,324, to Joseph W. Chambers, issued Sep. 6, 1977, entitled "SOLID WASTE COMMINUTION". This device has two interacting stacks of shredding members mounted on substantially parallel shafts and are positioned in transverse arrangement with respect to the direction of the waste material is introduced into the comminutor apparatus. A shredding disk of each stack interacts with a shredding member on the other stack, whereby the individual cutter members cooperately interact in pair within the comminutor. Teeth are provided on at least one member of each pair of shredding members for cutting during rotation thereof. The primary novlty of this prior art apparatus appears to to reside in the existence of cutter disks having shredding members or teeth for cutting in both directions of shaft rotation and the ability of the shafts to be driven in either direction, whereby the device cuts in both directions.

In another U.S. Pat. No. 4,690,340, to Takefumi Hatanaka, issued Sep. 1, 1987, entitled "Waste Material Shredder", there is disclosed an apparatus having a pair of counter-rotating cutter rollers with mutually meshing individual cutter disks mounted thereon and fixed individual spacer members separating the cutter disks. This device is directed toward eliminating jamming of the shredder due to the buildup of chips during the shredding of sheets of waste material between the spacers. Jamming of the device is said to be eliminated by a special configuration of the cutter disks, with chip clearance protrusions being formed between the peripheral teeth which act to remove such chips, thereby overcomming a problem with prior art "cross-cut" type shredders.

In yet another U.S. Pat. No. 4,565,330, to Hiroharm Katoh, issued Jan. 21, 1986, entitled "Shredding Apparatus", and U.S. Pat. No. 4,757,949, to Norman P. Horton, issued Jul. 19, 1988, entitled "Apparatus for Shredding Rubber Tires", each also discloses cutter disks with separating spacer disks disposed on substantially parallel twin shafts which are rotatable in opposing directions in intermeshing relationship.

In still another U.S. Pat. No. 3,860,180, to Albert Goldhammer, issued Jan. 14, 1975, entitled "Method and Apparatus for Destroying Documents", there is disclosed a method and apparatus for destroying documents in which opposed slitter rollers are provided that slit a document into longitudinal strips while the rollers are provided with means for cutting each longitudinal piece into a plurality of short sections.

Finally, in U.S. Pat. No. 3,633,831, to Marshall A. Dodson et al, issued Jan. 11, 1972, Entitled "Granular Device and Helical-Shaped Cutters Therefore ", there is disclosed a pair of meshing cutters used in a granular device having a pair of helical continuous tooth members such as one piece gears, which have each had their tooth shapes modified so as to exert a continuous scissors-type shear cutting action on material fed to them as a continuous web or as individual pieces or a combination thereof.

It should be noted that each of the above cited patented apparatus and other prior art patents not cited utilize as a necessity and novelty thereof, the individual cutter and spacer disk arrangements for their operaration and provision of such comminutor devices. Various protruding teeth configurations, multiple teeth on the cutter disks, differences in root diameters of the cutter teeth and spacers and the like are utilized to accommodate a variety of waste materials to enhance the utility of such prior art devices. However, none of the known prior art devices solves the long standing and continued problems of poor efficiency for shredding, sizing, jamming, distortion, broken teeth or dislodgement of cutter disks or teeth when such arrangements are utilized. Thus, it appears that the most commonly used techinues in the prior art are to use alternate stacking of cutter and spacer disks on shafts to provide an arrangement for the shredder inter-meshing or inter-action, and therefore, have either not realized or appreciated the need to provide a cutter body arrangement which is strong and durable, and which is capable of effectively distributing the stresses encounted therein along the axial length of the apparatus rather than having it concentrated on individual cutter and disk members as heretofore experienced.

SUMMARY OF THE INVENTION

An improved method for producing one-piece cutter members is provided for comminuting apparatus utilized for shredding, crushing and grinding bulk solid waste materials. The method or process provides means including investment cast molding, computer numerical control machining and/or electrical discharge machining, by which such one-piece cutter body members are created and adaptable to multiple parallel shaft comminutors, wherein such one-piece counter-rotating multiple toothed cutting members maybe disposed substantially parallel to one another in a device when fixedly engaging opposited rotating shafts thereof. The resulting novel one-piece body members have cutting teeth distributed along the length of the body member for intermeshing comminuting action with one another, and in a preferred embodiment of the invention the cutting teeth are shaped for cutting in both of two opposite directions of rotation, to thereby provide enhanced comminuting efficiency, reliability and ruggedness for such apparatus. The protrusions or teeth of cutter body member may be at regular spaced intervals around a cylindrical axial periphery of the cutter along and perpendicular to the axis of the shaft in a preselected configuration of a staggered-like arrangement. Along the length of the shaft the protruding teeth are in a formation that appears to be rows transverse to the axis of the shafts equally spaced apart from adjacent appearing rows. The intervening space formed between each apparent row of protruding teeth is in the form of a spacer whose diameter or root is less than that of a peripheral circle defined by the tips of the cutter teeth of each row adjacent thereto. Thus, when viewed from a direction transverse to the axis of the shaft, the multiple toothed cutter elements may appear to be a series of cutter-disks with alternate spacer disks similar in appearance to that of the prior art, but is in fact a unique one-piece structure, whose teeth form multiple spiral-like teeth patterns along the axis of the shafts. In accordance with the inventive concept of the present invention, such multiple toothed cutter elements may be only several inches in length or may be seversl feet long.

BRIEF DESCRIPTION OF THE DRAWINGS

Realization of the unique features and advantages along with others of the present invention will be more apparent from the following description and accompanying drawings in which.

DESCRIPTION OF REPRESENTATIVE EMBODIMENTS OF THE INVENTION

Figure 1:
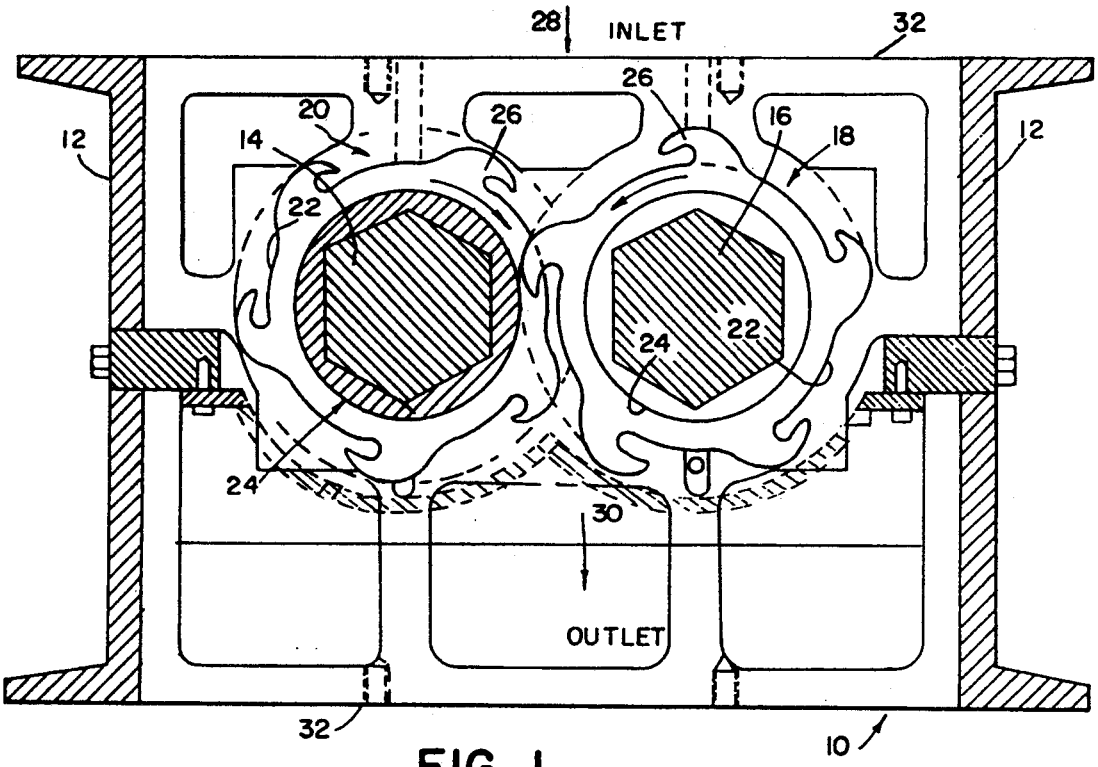
FIG. 1, is an illustrative cross-section view of the type of apparatus embodying the present invention and use of the one-piece body members.

Referring now to the various drawings, there is shown in FIG. 1, a representative embodiment of an improved comminuting apparatus 10 which includes a housing of trough-shaped configuration for accommodating twin shafts 14 and 16, and one-piece cutter body members 18 and 20 mounted respectively on twin shafts 14 and 16 that are hexagonal in their cross-section. A suitable drive arrangement, not shown, is connected to shafts 14 and 16 to provide opposing rotational motion thereto. The rotational speed of these shafts are different from each other and may be reversed in direction of rotation by means of such drive arrangement. There is a housing support member 30 which is used to support the shafts and cutter body member at one end of the apparatus. It should be noted that one or more cutter body members may be used to span the entire length of the device.

As shown in FIG. 1, the spaced apart fixed relationship of parallel twin shafts 14 and 16 are seen along with the relationship of opposing cutter body members 18 and 20. In this illustrative view cutting teeth 26 can be readily seen as to how they project outwardly from shafts 14 and 16, and their relative peripheral space relation. As shown teeth 26 extend radially from a circular portion 22 of bodies 18 and 20, and are axially concentric with another circular portion 24 thereof. The distance between circular portion 24 of the respective opposing rotating member defines the region along the axial length of the apparatus where crushing, tearing, shredding and the like of refuse material occurs. It should be noted that the teeth 26 on the different shafts cut in opposing angular directions.

Figure 2:
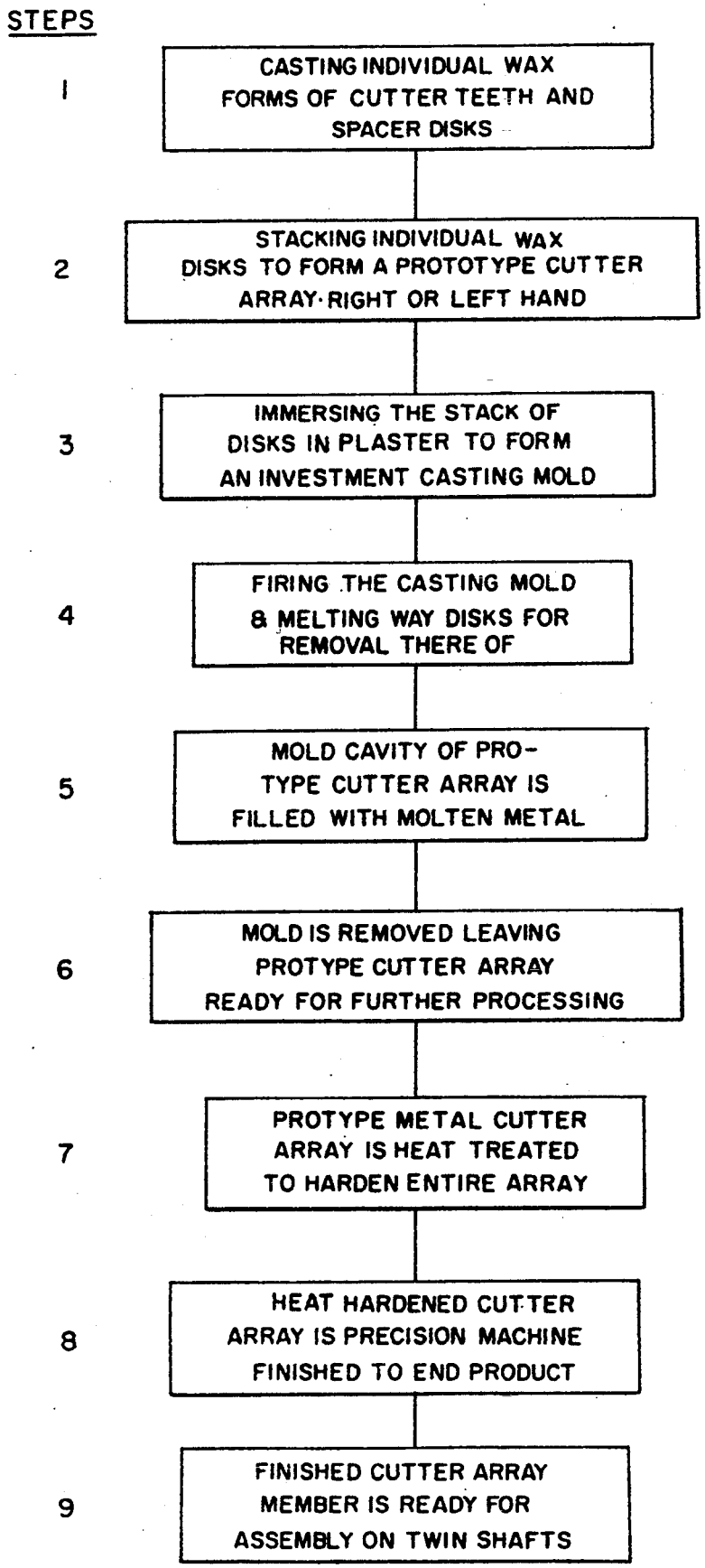
FIG. 2, is a block diagram illustrating the several steps in a process of investment cast molding for producing individual one-piece cutter body members for use in the apparatus illustrated in FIG. 1.
Figure 6:
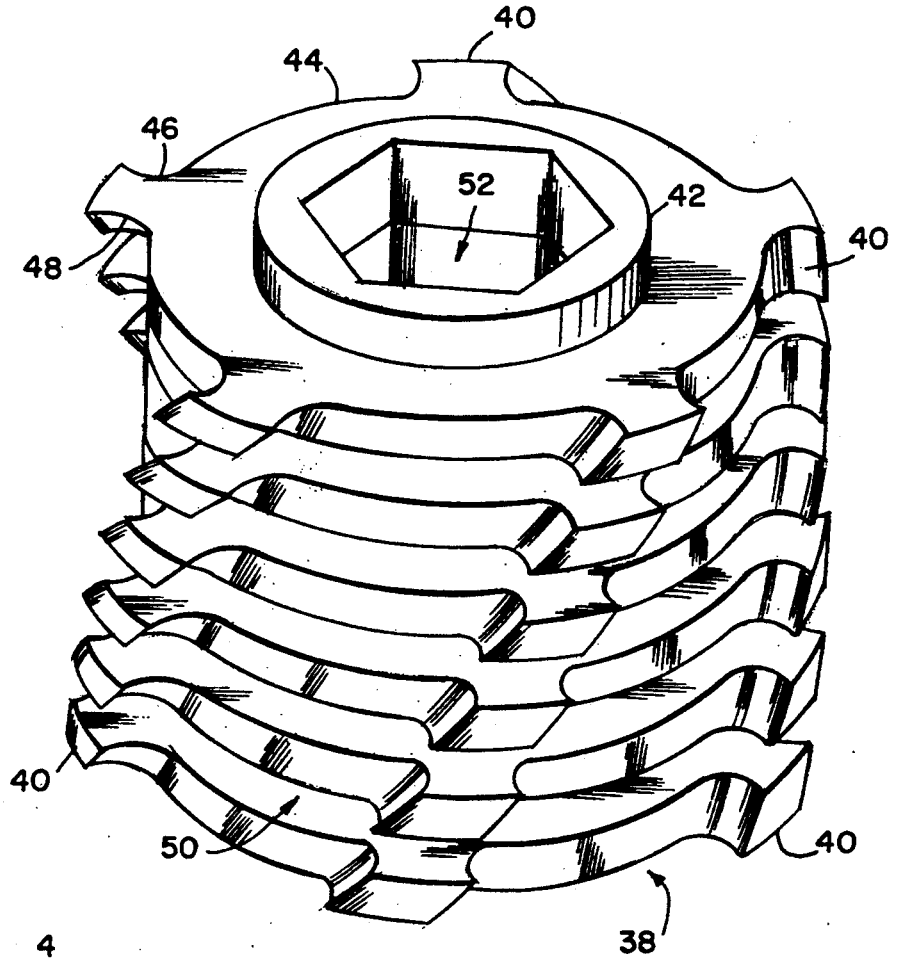
FIG. 6, is a perspective view of another typical cutter body member for the apparatus wherein the cutting teeth have a shape of configuration which permit cutting in both of two opposite directions of rotation and is produced by the process shown in FIG. 2.
Figure 3:
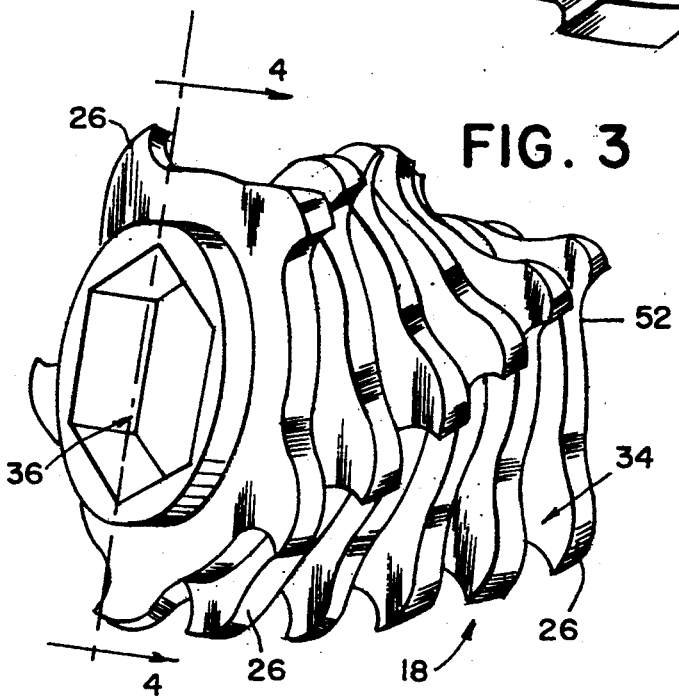
FIG. 3, is a perspective view of a twin shaft multiple toothed cutter member which is adaptable for the apparatus that is produced by the method shown in FIG. 2 and adaptable for use in the device illustrated in FIG. 1.

Referring now to FIG. 2, there is shown a block diagram depicting several steps of an investment cast molding process utilized in accordance with the present invention for for producing a typical cutter body member for use within comminuting apparatus as envisioned herein. More specifically, there is shown in FIG. 2, the nime basic steps to the method or process used for producing a one-piece cutter body member, such as member 18 as illustrated in FIGS. 3 or 6. Step 1, of the process requires that a suitable selected casting wax material be used to form one or more cutter disks having an opening at the center thereof, such as a hexagonal opening for example, with a predetermined number of cutting teeth projecting outwardly from the periphery thereof in desired spaced apart distances along the periphery; and one or more circular disks having a corresponding opening formed at the center thereof. The configuration, thickness and sizes of the various cutter or spacer disks may be readily controlled so as to provide greater flexibility in the design and production of a wide range of cutter body members for diverse applications and uses.

Step 2, of the method calls for the individual wax castings of the cutter and spacer disks formed to be stacked to form a prototype array of alternate cutters and spacers. The orientation or axial positioning of the cutter teeth is preselected, such as forming a staggered or spiral-like array for example, when multi-tooth cutter arrays are formed. The resulting configuration of an array may depend upon the axial length of the stacked array. The stacked array may be such that the cutting teeth form a clockwise or a counter-clock-wise configuration so that the opposing rotating members will intermesh with one another during operation of the comminuting machine. The clockwise or counter-clockwise relationship of rotation is often termed left-hand and right-hand orientation. It should be noted that under certain design and application conditions an array may consist of only a cutter and a spacer disk in the formation of a one-piece cutter body member.

Step 3, of the process calls for the alternately stacked cutter and spacer disks to be imersed in or appropriately coated with a suitable investment coating material, such as plaster for example, to form an investment casting mold of the stacked array of disks. The investment casting mold is then permitted to air dry and set firmly and hard.

Step 4, calls for the investment casting mold as a solid mass with the stacked array of wax disks therein to be fired at preselected elevated temperatures in an appropriately adapted firing furnace to melt the wax array of disks and the removal thereof and to temper the investment casting mold such that the mold is capatible with molten metal used to form the metal cutter body member envisioned by this invention.

Step 5 of the process, calls for filling the investment mold with a suitable molten metal, such as alloyed steel for example, which is permitted to solidify within the mold so as to form a metal array of the cutter and spacer disks as a one-piece cutter body member having the desired configuration of cutting teeth properly orientated and spaced apart from one another both concentrically and axially. As noted above, certain design considerations may dictate that the cutter body member consist only of one cutter and one spacer segment in an array.

Step 6, calls for the removal of the investment casting mold so that the one-piece cutter body member remains in tack and may be further processed.

Step 7, calls for the one-piece cutter array or body member to be suitably high temperature heat treated and quenched so as to produce the desired hardness, tensile strength and the like for the entire body, in particular the cutter tooth or teeth, for compatibility with uses envisioned therefor.

Step 8, calls for various precision machining of the body which for example may be performed by one or more versatile multi-axial computer numerical control precision machining centers, so as to produce the close tolerances and intricate configuration detaials of cutting teeth and spacings envisioned by the teachings of the invention.

Step 9 of the process, calls for placing one or more of the right or left hand cutter body members on their respective twin shafts for intermeshing opposing rotational action in a comminuting machine as envisioned herein.

It should be noted that a primary objective of the process thus disclosed and defined is to produce castings that are near-net shape, that is, produced close enough to the final dimensions of the cutter body such that machining is substantially reduced or eliminated. Experience with the present process, i.e. investment casting or loss-wax casting as the process is sometimes called, has proven useful as contemplated, in reducing significant precision machining. Materials such as selected liquid ceramic material mixtures may also be used in place of conventional plasters, owing to their high temperature stability capabilities during high temperature firing and dimensional conformity upon cooling. In practice the process has been found to produce body configurations with dimensional quality precise enough to enable production parts to be made which require little or no further precision machining.

Continuing with the description of the present invention, there is shown in FIG. 3, a perspective view of one-piece cutter body member 18 produced by the process of FIG. 2, having a plurality of cutting teeth 26, axially separated by spacing distances 34. Also shown is an axial hexagonal opening 36 into the body a selected distance at both ends thereof. In order to reduce the machining process for the hexagonal opening, the opening may be formed for a distance only a few teeth and spacers in depth, or for the entire length thereof as required. As can readily be seen from FIG. 3, the axial contour of teeth 26 have a spirial-like or staggered appearance.

This staggered-like configuration has proven beneficial in certain applications, while for certain other materials to be comminuted it may be desireable to have a random tooth array. In addition to flexibility of contours which may be derived in the body structure, the over-all strength and durability of the body has resulted. Contrary to the prior art cutter/spacer individual disk arrangements, the torsion, shear and the like forces developed during the comminuting process which are experienced by each tooth in the cutter body are distributed and/or dissipated along the entire axial length thereof so as to produce a body structure which has unusual and unexpected enhanced strength and durability over any known prior art device. In many operational tests of these body members it has been found that devices having cutter teeth whose widths, shapes and size are similar to the prior art devices with individual cutters and spacers, are able to carry working loads of at least 50% more than those of prior art devices.

Figure 4:
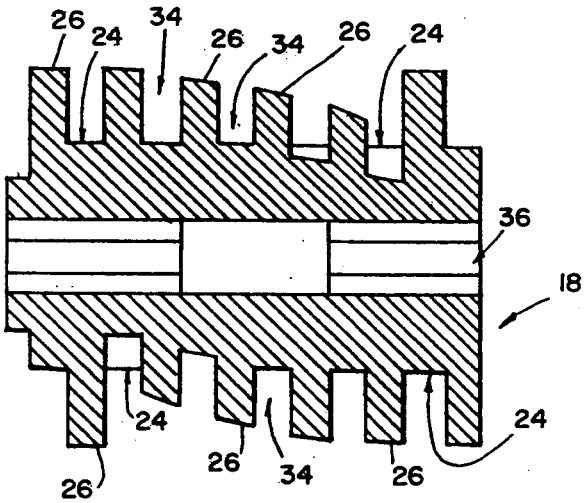
FIG. 4, is an illustrative cross-section view of a cutter body member, taken a along lines 4—4 of FIG. 3.

There is shown in FIG. 4, an illustrative cross-section view of the cutter body member 18 of FIG. 3 taken along lines 4—4 thereof. As shown in FIG. 4, a spiral-like effect of teeth 26 is readily seen, which results from the location and distribution of adjacent rows of teeth along the axial length of the cutter member. From this cross-section view of the configuration of the body it can also be seen and appreciated by those skilled in the art how various loads applied thereto may be distributed to obviate the concentration thereof at any one point in the body, thereby enhancing its inherent overall body and individual tooth strength and load bearing capacity.

Figure 5:
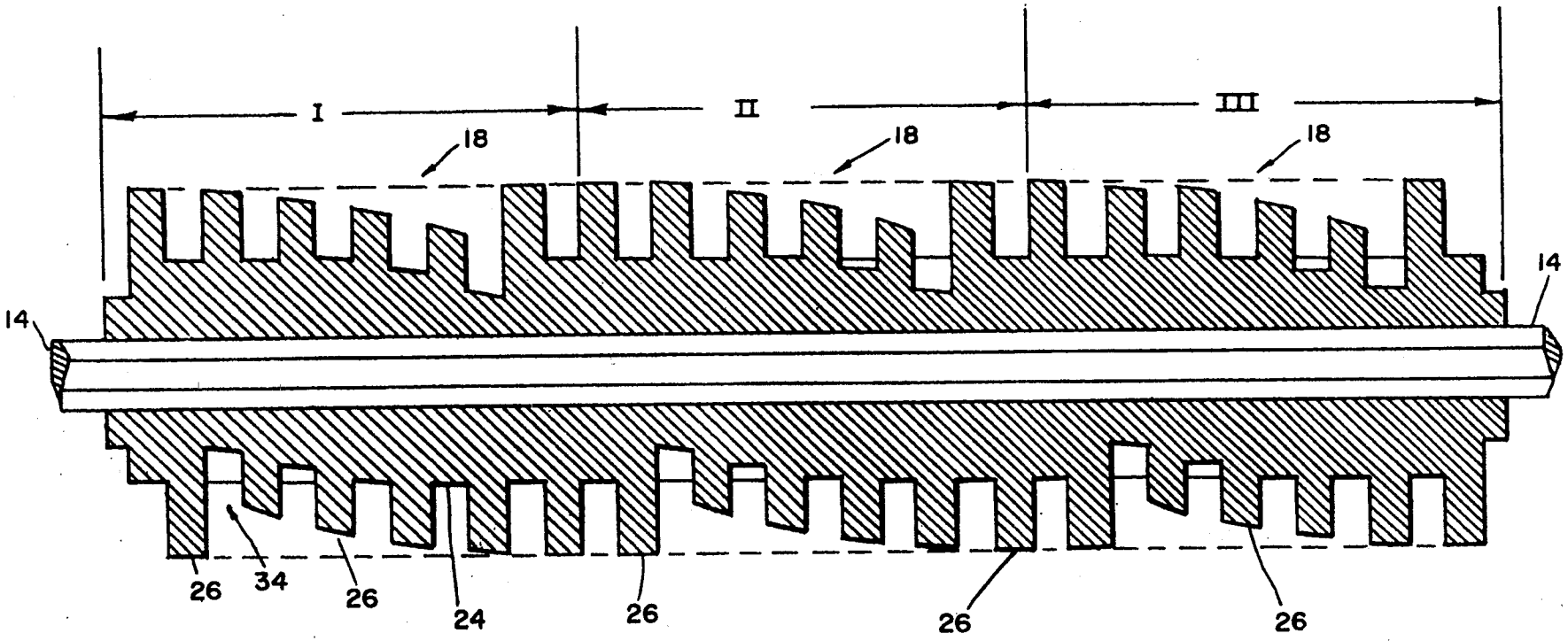
FIG. 5, is an illustrative cross-section view of multiple representative cutter body members for use on a twin shaft of an apparatus of the type shown in FIG. 1.

FIG. 5 is a cross-section view in-part of multiple segment one-piece cutter body 18 arrangement, mounted along a twin shaft 14 of the type shown in the various views, inparticular FIG. 4. As shown in FIG. 5 the cutter body 18 illustrates how more than one body member may be utilized interchangeably to form apparatus of various desired lengths depending upon the number of cutter bodies utilized. It can be seen from FIG. 5, that a variety of cutting teeth profiles can be created along the axial length of the cutter body which may produce unique teeth arrangements heretofore untainable in the prior art. It can also be recognized that the present inventive cutterr body members provide a convenient means for ease of repair and replacement to damaged parts. As shown each section I–III, profiles six teeth. However, a one-piece body member may have fewer or more teeth per member than is depicted. Removal of single unit or segment for replacement or repair is made easier and more convenient by use of such one-piece body members.

Referring now to FIG. 6, there is shown another cutter body member 38, similar to body members 18 and 20, except that it has a plurality of cutting teeth 40 having first and second cutting tooth surfaces 46 and 48, respectively designed for cutting or shredding action in opposing directions. As shown cutter body member 38 has an inner periphery circular surface 42 and an outer periphery circular surface 44, where the inner periphery surface 42 defines a depth which is slightly greater than the maximum depth of penetration of teeth 40 during intermeshing rotation action. The separation between adjacent teeth defines a spacing distance designated 50. Body member 38 has a hexagonal axial opening therethrough for fixedly engaging rotatable shafts upon which it resides during body member rotation.

Both body members 18 and 20, and 38 and it complementary body member which is not shown, may be produced by the method setforth in the investment cast molding process chart shown in FIG. 2. The investment cast molding process is considered a preferred embodiment of the invention. However, it should be noted that various configurations of cutter body member, including those shown in FIGS. 3 and 6, have been produced also by means of electrical discharge machining (EDM) and computer numerical control (CNC) maching techniques well known in the precision machine tool art. However, for volume production and complexity of body design it has been determined that the preferred process disclosed in connection with FIG. 2, as taught herein is preferred. It will be appreciated by those skilled in the precision machining tool art that CNC and EDM processing requires high levels of technical and machining know-how and skills, along with costly and sophicated equipment and machines to process the one-piece cutter body members of the types taught and envisioned by the present invention.

In closing, it should be noted that cutter body members 18 and 20 are held in fixed mounted and engaging position on their respective shafts, as a one-piece member which is created by use of the processes taught herein. These one-piece cutters have proven to be more efficient and reliable in operation than the prior art disk and spacer arrangements. In practice the methods of the present invention, in particular the preferred embodiment has proved to be relatively easy to execute with excellent results.

It is understood that the above described embodiments of the invention are only illustrative of the principals applicable thereto. Various modifications and adaptions may be envisioned by those skilled in the art when exposed to the disclosure and teachings herein, without departing from the spirit and scope of the invention and the claims appended hereto. For example, a varietr of tooth shapes and distributions thereof at the periphery of the cutter body may be produced by the processes of the present invention. In addition, the formation of the cutter body members may be processed by use of a suitable power laser system.

What is claimed as new is:

1. A method for producing a one-piece cutter body member for a twin shaft comminuting apparatus, comprising the following steps:

a. casting individual wax forms of multi-tooth cutter and spacer disks;

b. stacking alternately at least one of said wax cutter and spacer disks to form a cutter tooth and spacer array having having length;

c. immersing said array in or coating said array with an investment casting material to form an investment or loss-wax casting mold of said array;

d. firing said mold with said wax array of cutter teeth and spacer disks to thereby melt said wax for removal thereof from said investment or loss-wax casting mold;

e. filling a cavity formed in said mold upon removal of said wax, with a molten metal;

f. removing said casting mold after said molten metal has solidified within said cavity as a one-piece near-net shape body array of cutter teeth and spacer disk-like segments;

g. said one-piece array is heat treated in a suitable furnance to metal harden and strengthen said one-piece body; and h. selectively precision machine finishing said heat treated one-piece body array as required to thereby produce precision dimensions and configurations for portions thereof.

2. Claim 1, in which said array has at least one multitooth cutter and spacer disk therein.

3. Claim 1, in which said investment casting mold material is plaster or ceramic.

4. Claim 3, in which said multi-tooth cutter disks are stacked so that adjacent teeth of said disks form an angular staggered tooth relationship along said length of said array.

5. Claim 4, in which said open-piece cutter member body has an axial opening therethrough which is hexagonal in configuration.

6. A method for producing one-piece cutter body members for multiple parallel shaft comminuting apparatus for bulk solid waste materials, comprising the steps of:

a. using processing means for forming at least two complementary one-piece cutter body members each having an axial opening therethrough along a length thereof, said axial openings being adapted for fixed engagement with shafts of said comminuting apparatus;

b. using process means for forming a plurality of cutting teeth distributed along the length thereof for rotation with said shafts, said cutting teeth having a uniform thickness and being spaced from each other tooth along said length thereof by distances slightly greater than said thickness;

c. using process means forming an inner circular portion surrounding said axial opening and a plurality of spaced apart cutting teeth projecting from the periphery of a second circular body portion concentric with said inner circular portion, said cutting teeth on each of said body members being respectively alignable with a space between the cutting teeth on a similar intermeshing cutter body member being situated from each other by a distance which locates the peripheries of said inner circular portion of said cutter body member so that said cutting teeth of one cutter body passes through spaces between the cutting teeth of said similar intermeshing cutter body; and d. using process means for forming said cutting teeth of said similar intermeshing cutter body member so as to produce a reverse spiral-like configuration of each other so as to produce smooth intermeshing action during opposing rotation therebetween when disposed in parallel space relationship to one another on parallel shafts of a bulk solid waste material comminuting apparatus.

7. Claim 6, in which said means for forming said one-piece cutter body members are performed sustantially by machining of said cutter body members.

8. Claim 6, in which said means forforming said one-piece cutter body members are performed by electrical discharge machining of said cutter members.

9. Claim 7, in which said machining of said cutter body membw body members are performed substantially by computer numerical control machining.

10. Claim 6, in which said cutting teeth are shaped for cu cutting in both of two opposite directions of intermeshing rotation.

11. Claim 6, in which said axial openings are hexagonal.

12. Claim 6, in which said cutting teeth form an angular staggered tooth relationship along said length of said cutter body members.

13. Claim 6, in which said means for forming of said one-piece cutter body members are performed by a laser processing apparatus.

* * * * *